US005740570A

United States Patent [19]

Hsieh

[11] Patent Number: 5,740,570

[45] Date of Patent: Apr. 21, 1998

[54] COLLAPSIBLE HAMMOCK

[76] Inventor: Wan-Lai Hsieh, Suite 2, 7F, No. 95-8, Chang Ping Road, Sec. 1, Taichung, Taiwan

[21] Appl. No.: 695,808

[22] Filed: Aug. 12, 1996

[51] Int. Cl.[6] ..... A45F 3/24

[52] U.S. Cl. ..... 5/129; 5/127

[58] Field of Search ..... 5/120, 127–130

[56] References Cited

U.S. PATENT DOCUMENTS 965,476 7/1910 Meyer ..... 5/129

FOREIGN PATENT DOCUMENTS 705671 3/1931 France ..... 5/129

455530 3/1950 Italy ..... 5/129

*Primary Examiner*—Flemming Saether

[57] ABSTRACT

A collapsible hammock comprises an elongate stand of dovetail section and an open bottom having a first portion slidably receivable into a second portion and detained by a retaining device, a pair of support releasably secured to the bottom of the stand, a rectangular socket projected upward from two ends of the stand having a groove composed of a square cavity and a pair of L-shaped guide slots formed for slidably and pivotally coupling a pair of rectangular posts therein and a pair of square caps sleeved on the top of the posts each having a hook on an inward surface for suspending from a suspension bed therebetween. The hammock of the present invention is characterized in a stretchy and releasable structure which facilitates the hammock to be portable and saves space to store or packing for transportation.

9 Claims, 4 Drawing Sheets

COLLAPSIBLE HAMMOCK

BACKGROUND OF THE INVENTION

The present invention relates to hammocks, and more particularly to a collapsible hammock which has a telescopic stand, a pair of collapsible posts and a pair of collapsible supports for readily collapsing the hammock when is not in use.

Typical hammock (as shown in FIG. 1) is composed of a stand 10, a pair of supports 11 and 12 secured spaced apart to the stand 10, a pair of posts 13 and 14 and a suspension bed 15 wherein the stand 10 has a pair of recesses 101 and 102 at two ends for anchoring posts 13 and 14. The posts 13 and 14 each has a hooks 131 and 141 secured to an upper periphery for suspending from the suspension bed therebetween. This structure has numerous disadvantages outlined as follows:

a) the stand 10 and the support 12 are of solid structure which occupy a big space when are not in use and is not to be portable, and b) other elements such as the posts 13 and 14 separated from the stand 10 will be lost during transportation.

SUMMARY OF THE PRESENT INVENTION

The present invention has a main object to provide a collapsible hammock which has a telescopic stand can be stretched or contracted to save space when is not in use.

Another object of the present invention is to provide a collapsible hammock has a pair of posts collapsible into the stand to prevent the posts from to be lost during transportation.

Still another object of the present invention is to provide a collapsible hammock which has a pair of supports collapsible into the stand for saving space to pack.

The present invention will become more fully understood by reference to the following detailed description thereof when read in conjunction with the attached drawings.

DETAILED DESCRIPTION OF THE PREFERRED EMBODIMENT

Figure 2:
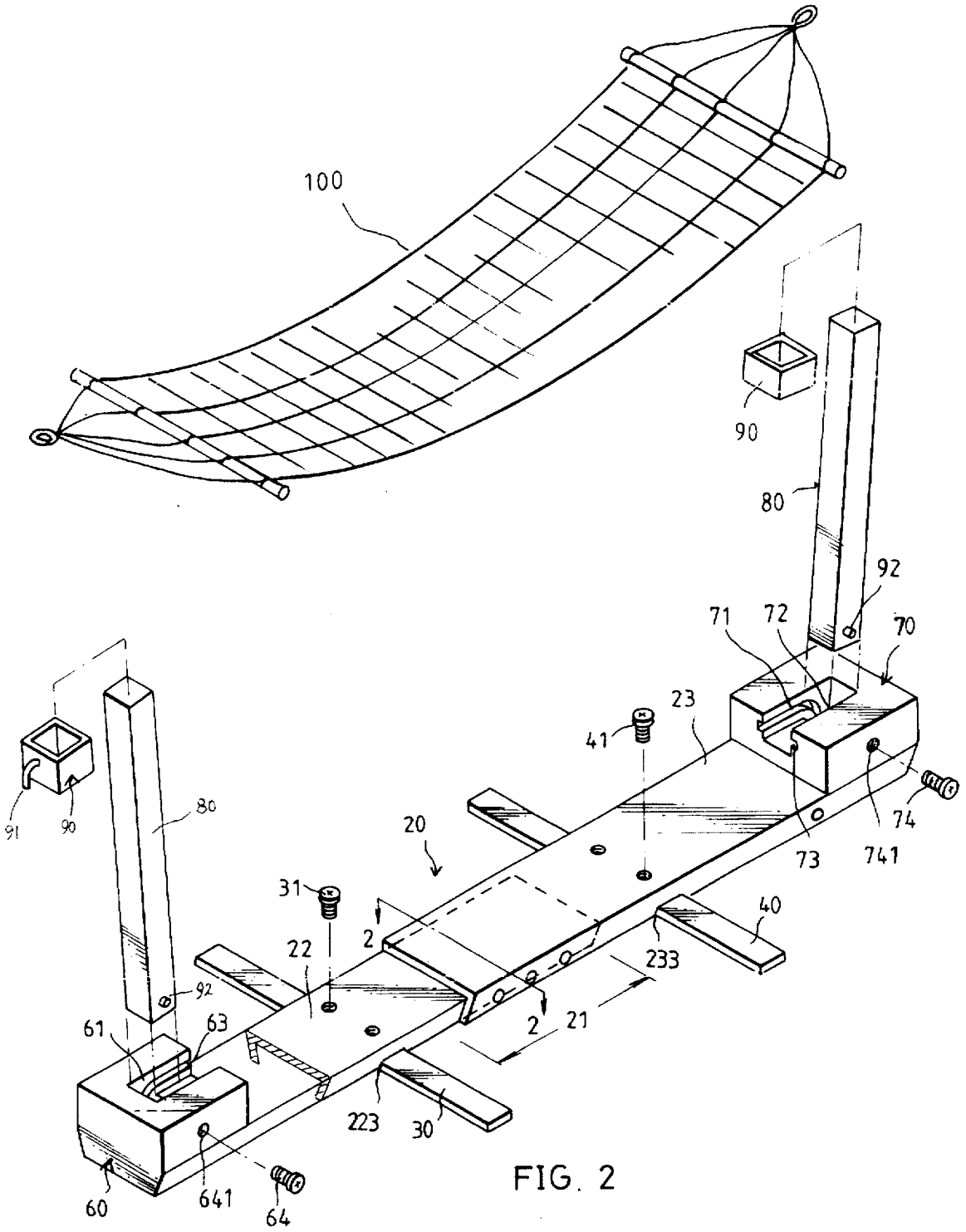
FIG. 2 is a perspective view to show a preferred embodiment of the present invention.
Figure 3:
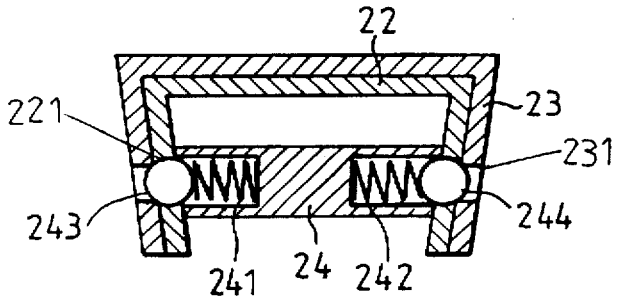
FIG. 3 is a sectional view taken along line 2—2 of FIG. 2 which illustrates a first retaining device of the present invention.

With reference to FIG. 2 of the drawings, the collapsible hammock of the present invention comprises generally an elongate telescopic stand 20 of a dovetail section which includes a first portion 22 receivable in a second portion 23 each has a hollow interior and an opened bottom. The first portion 22 can be slid about in the second portion 23 and is detained in a first retaining device 21 which is located in the free end of the first portion 22 as shown in FIG. 3 and comprises a transverse cylinder 24 perpendicularly connected to the inward surface of the lateral walls of the first portion 22. The transverse cylinder 24 has cavities in two ends communicating a recess 221 in each of the lateral walls, a pair of first compression springs 241 and 242 anchored in the cavities respectively each biases a steel ball 243 and 244 at outward end. In the lateral walls of the second portion 23 each has at leas three recesses 231 formed spaced apart within the retaining device 21 and made in registry with the recesses 221. When sliding about the first portion 22 in the second portion 23 and the recesses 221 engaged with one of the recesses 231, the steel balls 243 and 244 will be biased by the springs 241 and 242 and moving outward to stop between the recesses 221 and 231. So that the first portion 22 is retained. Each of the recesses 231 defines a predetermined length for the stand 20 in order to cope with different size of a suspension bed. When the hammock is not in use, the first portion 22 can be further contracted into the first portion 23 so as to facilitate the hammock to be portable.

Figure 4:
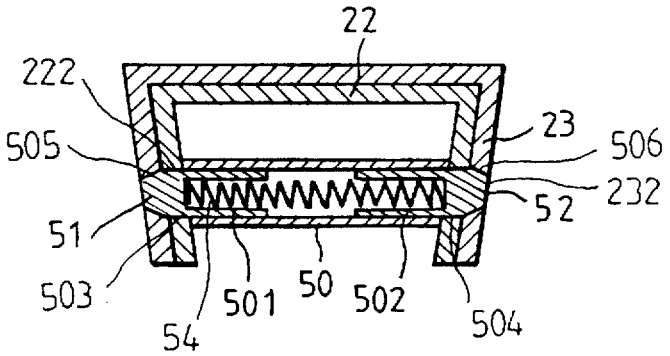
FIG. 4 is a sectional view to show a second retaining device of the present invention.
Figure 5:
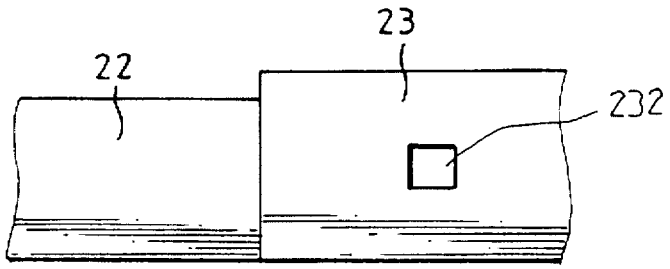
FIG. 5 is a side view illustrating a tapered rectangular recess in the stand of the present invention.

Referring to FIG. 4, a second retaining device 50 is shown. The device 50 which has the function similar to the first retaining device 21 that is replaceable with each other and comprises a hollow cylinder body connected on two ends to the inner surface of the lateral walls of the first portion 22 communicating respectively with a pair of rectangular recesses 222 in the lateral walls, a single but longer second compression spring 54 disposed in the cylinder body and biased at two ends a pair of slides 51 and 52 each has a cylinder sleeve 501 and 502 of an outer diameter equal to the inner diameter of the cylinder body and sleeved on respective ends of the second spring 54, a rectangular ends 503 and 504 made in registry with the rectangular recesses 222 so as to slide thereabout and a tapered heads 505 and 506 made in registry with the tapered recesses 232 in the lateral walls of the second portion 23, when the rectangular recess 222 of the first portion 22 engages with any one of the tapered recesses 232, the tapered heads 505 and 506 will be urged by the spring 54 moving forward to stop in the tapered recesses 232 thus to retain the first portion 22 of the stand 20 hereto (as shown in FIG. 5).

Again referring to FIG. 1, the first and second portions 22 and 23 of the stand 20 each has a pair of rectangular slots 223 and 233 for releasably engaging with a pair of supports 30 and 40 which have a pair of screw holes spacedly formed in the medial planar surface (not shown) for releasable securing to the respective first and second portions 22 and 23 by means of screws 31 and 41. When the hammock 20 is not in use, the supports 30 and 40 are removed at first by unfastening the screws 31 and 41 and disposed the supports 30 and 40 in the hollow interior of the first portion 22 and parallel to the longitudinal axis of the first portion 22 and then secured by the screws 31 and 41 at their exist screw holes. Finally contracts the first portion 22 into the second portion 23 of the stand 20. So that it saves a great deal of space to put the stand 20.

Figure 1:
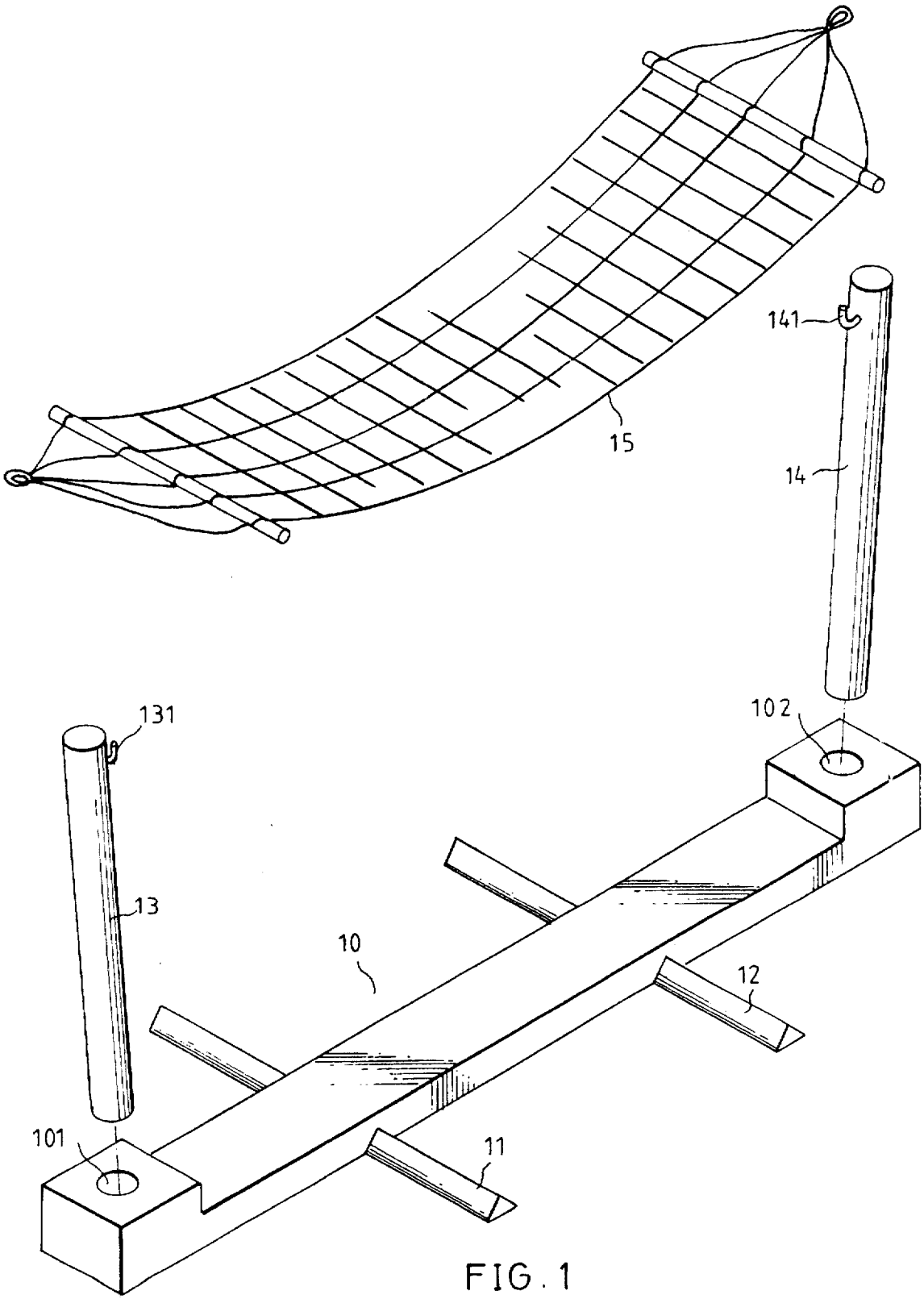
FIG. 1 PRIOR ART
FIG. 1 is a perspective view to show a hammock of a prior art.
Figure 6:
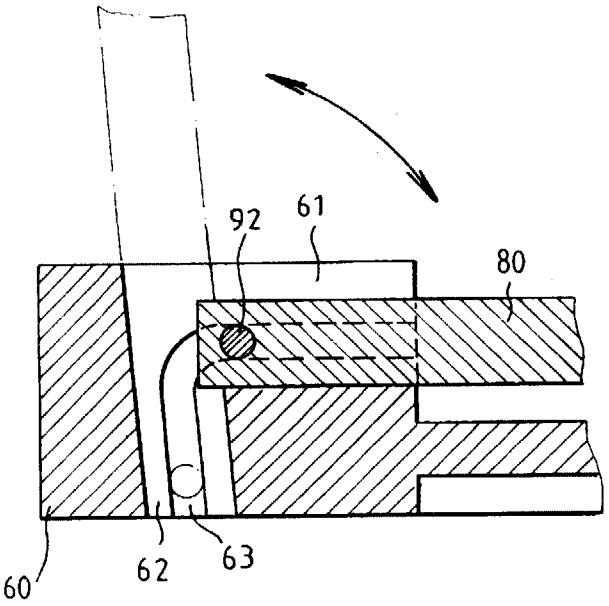
FIG. 6 is a sectional view to show a cavity in a socket of the stand.

Referring to FIGS. 1 and 6 of the drawings, the first and second portions 22 and 23 of the stand 20 each has a socket members 60 and 70 projected upward from their free ends for releasably securing in a pair of rectangular posts 80. The socket members 60 and 70 each comprises a rectangular grooves 61 and 71 having their openings toward inward sides relative to the hammock, a square cavity 62 and 72 extended downward from the bottom of the grooves 61 and 71 abutting the inner wall of the grooves 61 and 71 and a pair of roughly L-shaped guide slots 63 and 73 first extended horizontally along the center of the lateral walls of the grooves 61 and 71 and then extended continuously downwardly along the center of the lateral walls of the cavities 62 and 72 and terminated at the lower end of the cavities 62 and 72. Note that the socket member 70 is slightly higher than the socket member 60 (as shown in FIG. 7).

A pair of rectangular posts 80 each of which has a square section equal to the size of the cavities 62 and 72 and the width of the grooves 61 and 71 and each has a pair of axle rods 92 centrally extended outward from the lower lateral surfaces made in coped with the L-shaped guide slots 63 and 73. A pair of square caps 90 sleeve on the top of the rectangular posts 80 and each has a hook means 91 toward inward for suspending from a suspension bed 100 therebetween.

The posts 80 have their axle rods 92 engaged into the respective guide slots 63 and 73 and slid thereabout first horizontally and then downwardly until that the lower ends of the posts 80 engaged into the respective cavities 62 and 72 and retained by screws 64 and 74 through a lateral screw holes 641 and 741. The rectangular posts 80 may have a tapered lower end made in cooperation with a tapered cavity 62' and 72'(not shown) in the grooves 61 and 71. This will make the posts 80 more engageable with the cavities 62' and 72'

Figure 7:
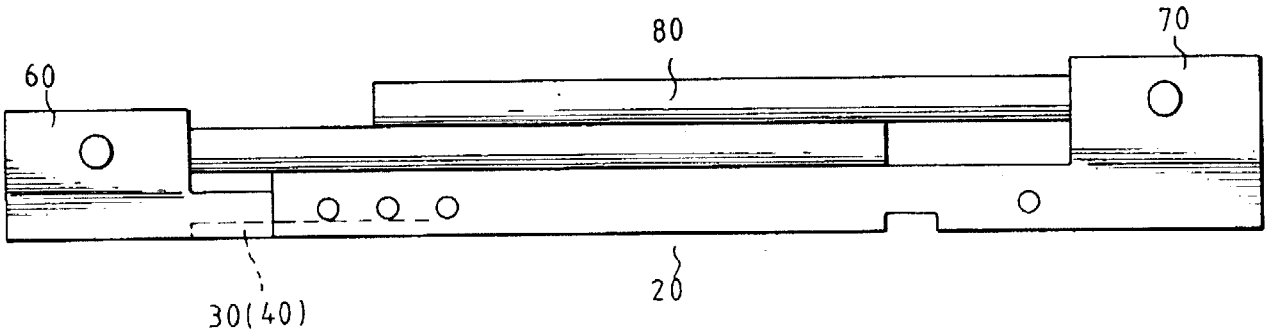
FIG. 7 is a side view illustrating the elements of the hammock collapsed into the stand.

When collapsing, first remove the supports 30 and 40 and fix them under the first portion 22 in the manner as recited above and contract the first portion 22 into the second portion 23 for a predetermined span and then slightly unfastening the screws 64 and 74 so as to permit the pair of rectangular posts 80 rotating inwardly for about 90 degrees in order to superposedly lie on the upper surface of the second portion 23 (as shown in FIGS. 6 and 7). Therefore, the hammock of the present invention is collapsed and saves a great deal of space to store or to pack for transportation, other components such as the caps 90 and the suspension bed 100 can be packed and fixed in the superfluity under the first portion 22 of the stand Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A collapsible hammock comprising:

an elongate telescopic stand of dovetail section and open bottom including a first portion slidably receivable in a second portion and detained by a first retaining device in a free end of said first portion, said first retaining device comprising a cylinder body connected on two ends to an inward surface of lateral walls of said first portion, a cavity formed in each of said end aligned with a first recess in one of the lateral walls of said first portion for receiving a first compression spring and a steel ball biased in said first recess by said spring, and a plurality of second recesses formed spaced apart in each of the lateral walls of said second portion and made in registry with said first recess of said first portion;

a pair of rectangular slots formed in bottom of the opposite lateral wall of said first and second portions for releasably securing a pair of supports by means of screws;

a rectangular socket member projected upward from other end of said first and second portion, said socket member comprising a rectangular groove centrally formed having an opening toward inward relative to the hammock, a square cavity extended downward from an inner bottom of said groove and a pair of L-shaped guide slots extended horizontally along a center of lateral walls of said groove and then extended continuously downward along a center of lateral walls of said square cavity and terminated at a bottom of said square cavity;

a pair of rectangular posts of a square section equal to that of said square cavity and a width of said groove having a pair of axle rods made in registry with said L-shaped guide slots of said groove for facilitating said posts slidably and pivotally anchored in the groove and in addition to the square cavity of said rectangular sockets projected outward from lower lateral surfaces thereof and a pair of square caps sleeved on a top of said posts each having a hook means projected outward a lateral surface for suspending from a suspension bed therebetween.

2. A collapsible hammock as recited in claim 1 wherein said rectangular socket of said second portion is higher than that of said first portion.

3. A collapsible hammock as recited in claim 1 wherein said posts each has a tapered lower end.

4. A collapsible hammock as recited in claim 1 wherein said rectangular sockets each has a tapered cavity.

5. A collapsible hammock comprising: an elongate telescopic stand of dovetail section and open bottom including a first portion slidably receivable in a second portion and detained by a second retaining device in a free end of said first portion, said second retaining device comprising a hollow cylinder body connected on two ends to a pair of square recesses in lateral walls of said first portion, a longer second spring disposed into said body, a pair of slides sleeved on two ends of said second spring and sliding into two ends of said hollow cylinder, said slides each having a tubular sleeve, a square end made in registry with said square recesses of said first portion and a tapered head made in registry with a tapered recess in each of the lateral walls of said second portion of said stand.

a pair of rectangular slots formed in bottom of the opposite lateral wall of said first and second portions for releasably securing a pair of supports by means of screws;

a rectangular socket member projected upward from other end of said first and second portion, said socket member comprising a rectangular groove centrally formed having an opening toward inward relative to the hammock, a square cavity extended downward from an inner bottom of said groove and a pair of L-shaped guide slots extended horizontally along a center of lateral walls of said groove and then extended continuously downward along a center of lateral walls of said square cavity and terminated at a bottom of said square cavity;

a pair of rectangular posts of a square section equal to that of said square cavity and a width of said groove having a pair of axle rods made in registry with said L-shaped guide slots of said groove for facilitating said posts slidably and pivotally anchored in the groove and in addition to the square cavity of said rectangular sockets projected outward from lower lateral surfaces thereof and a pair of square caps sleeved on a top of said posts each having a hook means projected outward a lateral surface for suspending from a suspension bed therebetween.

6. A collapsible hammock as recited in claim 5 wherein there are a plurality of said tapered recesses.

7. A collapsible hammock as recited in claim 5 wherein said rectangular socket of said second portion is higher than that of said first portion.

8. A collapsible hammock as recited in claim 5 wherein said posts each has a tapered lower end.

9. A collapsible hammock as recited in claim 5 wherein said rectangular sockets each has a tapered cavity.

* * * * *